United States Patent [19]

Tevis

[11] 3,942,963

[45] Mar. 9, 1976

[54] VACUUM CLEANING SYSTEM

[75] Inventor: Felix H. Tevis, South Pasadena, Calif.

[73] Assignee: Tevis-Campbell Corporation, South Pasadena, Calif.

[22] Filed: Feb. 15, 1973

[21] Appl. No.: 332,599

[52] U.S. Cl. ..... 55/380; 15/350; 15/314; 15/327 D; 55/381; 55/467; 55/DIG. 3

[51] Int. Cl.[2] ..... B01D 46/02

[58] Field of Search ..... 55/366, 372, 414, DIG. 3, 55/467, 470–473; 15/301, 313, 314, 326, 327 R, 327 A, 327 B, 327 C, 327 D, 327 E, 350, 351

[56] References Cited

UNITED STATES PATENTS

| | | | |
|---|---|---|---|
| 2,721,624 | 10/1955 | Osborn | 55/380 |
| 3,023,447 | 3/1962 | Senne | 55/378 |
| 3,226,758 | 1/1966 | Brown et al. | 15/350 |
| 3,267,650 | 8/1966 | Landin | 15/350 |
| 3,328,826 | 7/1967 | Amos | 55/372 |
| 3,383,839 | 5/1968 | Hintermaier | 55/378 |
| 3,626,545 | 12/1971 | Sparrow | 15/339 |
| 3,676,986 | 7/1972 | Reiling | 15/327 E |
| 3,714,765 | 2/1973 | Simonelli | 15/327 R |

FOREIGN PATENTS OR APPLICATIONS

| | | | |
|---|---|---|---|
| 812,886 | 5/1959 | United Kingdom | 15/327 A |

*Primary Examiner*—Bernard Nozick
*Attorney, Agent, or Firm*—Lyon & Lyon

[57] ABSTRACT

A vacuum cleaning system includes a stationary built-in power unit, a portable vacuum unit, and a flexible hose connecting the power unit and vacuum unit. Dirt and other particulate matter sucked into the system is trapped within a collection chamber of the vacuum unit and air within the collection chamber is evacuated therefrom to pass through the hose and the motor of the power unit.

15 Claims, 16 Drawing Figures

7
7
14
16
130
131
132
133
134
136
138
140
142
143
144
146
148
150
152
154
156
158
160
162
163
164
166
168
170
171
172
175
176
178
184
186
188
190
191
192
194
210
220
222
226
228
238
250
252
254
258
260
262
264
266
268
270
272
274
276
278
280
282
284
286

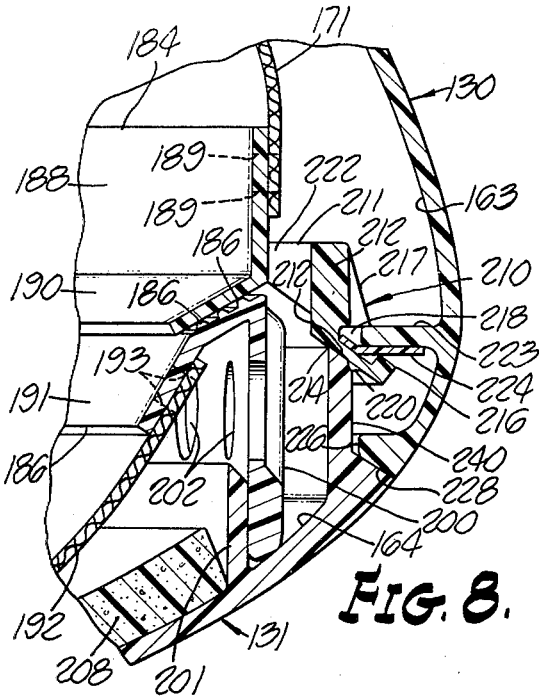
FIG. 8.
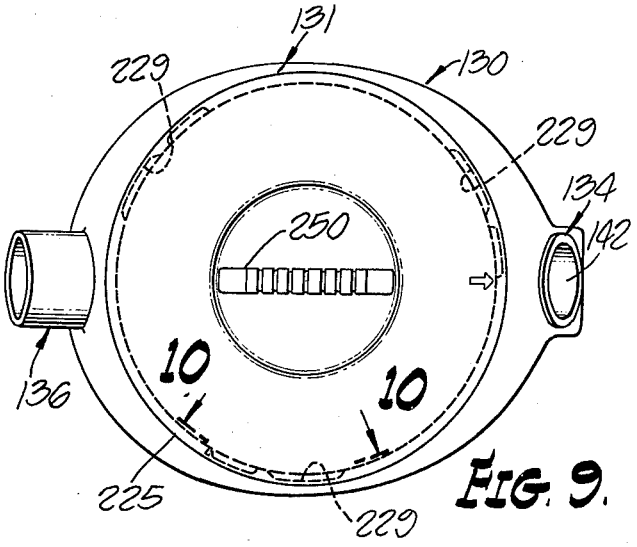
FIG. 9.
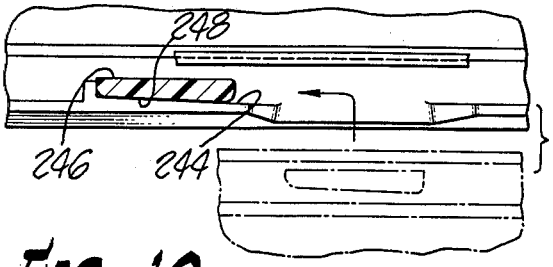
FIG. 10.
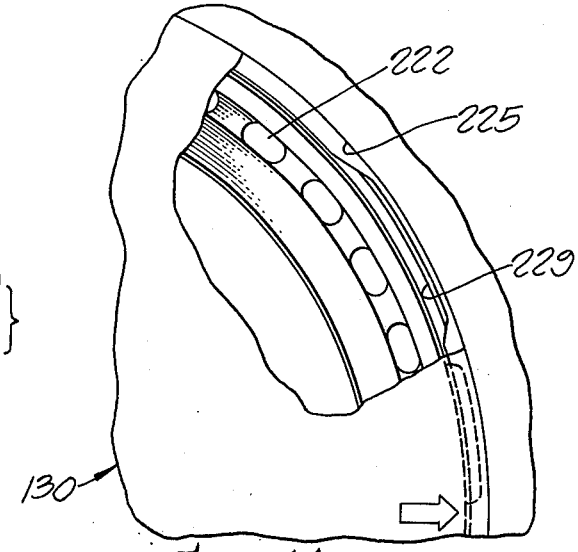
FIG. 11.
FIG. 12.
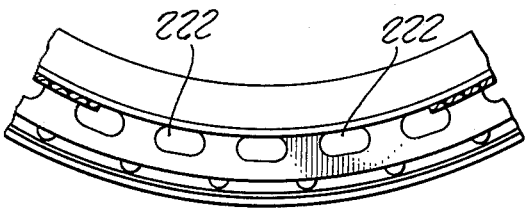
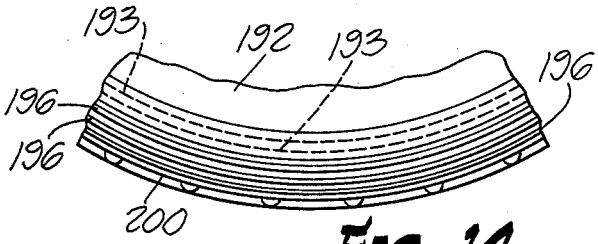
FIG. 14.
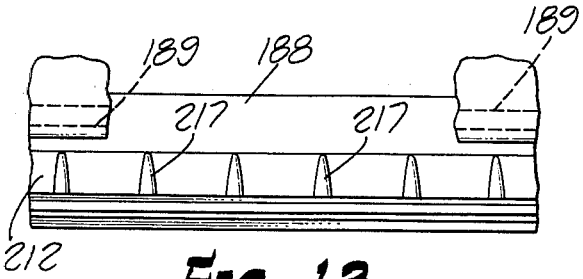
FIG. 13.
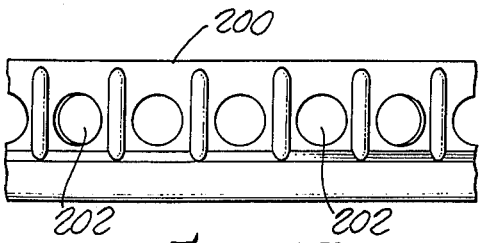
FIG. 15.

VACUUM CLEANING SYSTEM

This invention relates to a vacuum cleaning system and more particularly relates to a vacuum cleaning system of the type having a built-in power unit.

Such systems enjoy a distinct advantage over conventional self-contained vacuum cleaners in that the carrying of the relatively heavy vacuum cleaner to the area to be vacuumed as well as the pushing or pulling of the vacuum cleaner during the vacuuming process is avoided thereby substantially lessening the effort required for such cleaning. Moreover, the subsequent storage of the relatively large and unwieldy vacuum cleaner is eliminated, a feature particularly important with respect to dwellings of limited space such as apartments and mobile homes.

However, although numerous such built-in vacuum cleaning systems have previously been proposed, the limitations and disadvantages generally associated therewith have resulted in less than widespread public acceptance of such systems. The problems or disadvantages most commonly associated with such built-in vacuum systems heretofore used involve relatively poor operating efficiencies and relatively frequent breakdowns in the systems which are difficult to repair. The low operating efficiencies are oftentimes the result of an insufficient sealing of the system against air leakage or a so-called snowdrifting of the dirt or other particulate matter within a collection chamber of the system, both of which substantially reduce the suction force of the system. Malfunctioning of such systems usually is a result of dirt or other particulate matter becoming clogged within the sinuous flexible hose of the system or passing into the motor of the power unit.

Other disadvantages associated with heretofore used built-in vacuum systems include limited cleaning area coverage and restricting installation requirements.

Therefore, it is a primary object of the present invention to provide a vacuum cleaning system with a built-in power unit having new and improved dirt collecting characteristics which avoids snowdrifting of dirt or other particulate matter within the collection chamber and thus the decrease in operating efficiency associated with such snowdrifting. Another important object of the present invention is to provide improved sealing of the system against leakage of dirt or other particulate matter collected and loss of air passing through the system.

Still another object of the present invention is to provide an improved filtering and/or screening of the particulate matter sucked into the system and thereby prevent particulate matter from clogging the flexible hose of the system or impair the operation of the power unit. Another object of the invention is to provide a vacuum cleaning system having a built-in power unit with versatile mounting capabilities thereby permitting relatively easy installation of the power unit for both new and old building constructions and various different types of dwellings. In addition, it is another object of the present invention to provide a power unit with improved accessibility to thereby increase the cleaning area coverage of the system without increasing the overall length of the flexible hose of the system.

In accordance with these and other objects, the present invention briefly comprises a power unit adapted to be installed within a wall or floor structure of a dwelling, a portable lightweight vacuum unit adapted to trap and collect the particulate matter sucked into the system, and a flexible hose or conduit connecting the power unit and vacuum unit. The power unit is provided with a dual inlet so that the power unit when installed within a wall structure is accessible from either side of the wall. The vacuum unit is provided with improved air and dirt seals to prevent a leakage of air passing through the system and a leakage of dirt or particulate matter into the flexible hose or power unit. The vacuum unit also includes a collection chamber which permits evacuation of air therefrom substantially uniformly across the entire filter media surface area thereof.

Other objects of the present invention include the provision of a portable vacuum unit which is relatively lightweight, readily maneuverable and easy to clean and the provision of a system which is relatively inexpensive.

Other objects and advantages of the present invention will be made readily apparent from the following detailed description and the accompanying drawings, wherein:

FIG. 8 is an enlarged fragmentary side sectional view illustrating the air and dirt sealing of the vacuum unit;

FIG. 9 is a bottom view of the vacuum unit;

FIG. 10 is a fragmentary view illustrating the lid and container connection of the vacuum unit taken substantially along the lines 10—10 of FIG. 9;

FIG. 11 is another fragmentary view illustrating the lid and container connection of the vacuum unit;

FIGS. 12 through 15 are fragmentary views illustrating various components of the air and dirt seal assemblies of the vacuum unit.

Figure 1:
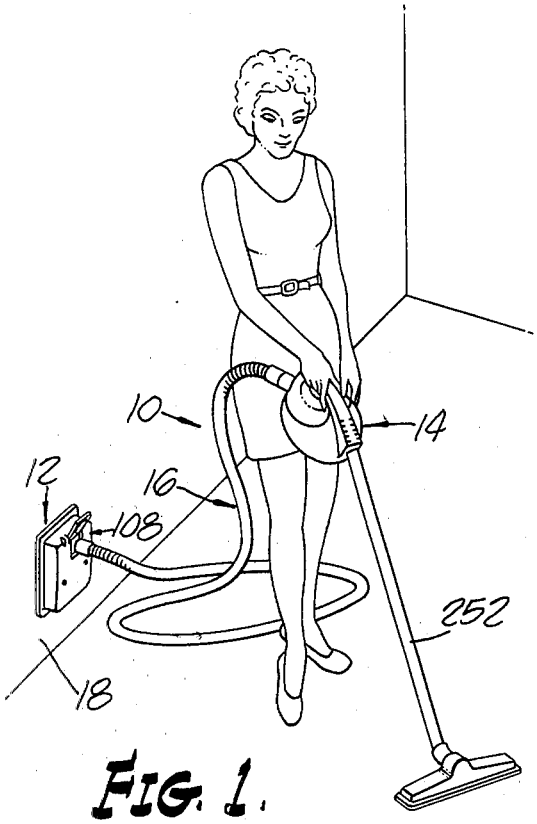
FIG. 1 is an overall prespective view illustrating the vacuum cleaning system in use.

Referring now in detail to the drawings, a preferred embodiment of the vacuum cleaning system of the present invention, generally designated 10, broadly includes a stationary power unit, generally designated 12, a portable vacuum unit, generally designated 14, which is adapted to receive conventional vacuum cleaning implements, and a flexible suction hose, generally designated 16, which is connected at one end to the power unit 12 and connected at the other end to the vacuum unit 14.

As shown in FIGS. 1 through 4, the power unit 12 is installed largely within a building wall structure 18. However, it should be noted that the power unit 12 is also adaptable for installation within a floor structure which may be preferable for space saving reasons when employing the vacuum cleaning system 10 in mobile homes or the like. The power unit 12 is a self-contained unit and includes a generally rectangular and open-sided metal casing 20, with a sidewall thereof adapted to be mounted adjacent a stud 22 or similar support member within the wall or floor structure.

A mounting bracket 24 secured to the stud 22 by nails 26 or the like includes a pair of turned-in integral ears 28 which are received by slot openings (not shown) in a rear corner of one side of the casing 20. The forward end of the mounting bracket 24 is provided with an opening at 30 which receives a screw 32 or the like extending through an aligned opening at the front of the sidewall 34 of the casing 20 to further secure the casing 20 to the mounting bracket 24. It should be noted that rear corners of both of the opposite sidewalls 34 and 36 of the casing 20 are provided with the ear receiving slot openings and each sidewall also includes a screw opening to thereby permit the mounting of the casing 20 to a stud or supporting structure on either side of the casing. Moreover, the sidewalls 34 and 36 together with the top and bottom of the casing 20 all taper slightly outwardly from the rear wall thereof to provide for an improved mounting of the casing.

Contained generally within the casing 20 is an assembly, generally designated 38, including an insulating divider member 40 preferably formed of plastic material which generally defines a power compartment 42 and an air inlet plenum 44. Air suction means in the form of an electrically operable blower motor 46 having a rotary fan (not shown) is located in the power compartment 42 and includes a motor housing 48 having a central air inlet 50 which is in communication with the plenum 44 by way of a suitable opening 52 in the divider 40. A resilient gasket 53 extending co-axially about the inlet 50 and compressed between the housing 48 and divider 40 prevents a leakage of air therebetween. A filter element or screen 54 extending across the opening 52 is also provided to prevent particulate matter from entering the motor 46. The other end of the motor housing 48 is enclosed by a generally elliptical metal shroud or motor base cap 56 having a plurality of air outlet openings 58. These openings 58 which extend circumferentially about the shroud 56 substantially eliminate any restriction of the air as it is discharged from the motor or suction device 46. The open end of the shroud 56 includes an outwardly turned periphery 59 which is secured to the open end of the divider 40 by means such as bolts 60 and is also secured to the motor housing 48 by means such as bolts 61. This entire assembly 38 is in turn slidably mounted within the casing 20 with outwardly extending side flanges 62 of the shroud 56 being supported on interior ribs 63 of the casing sidewalls and exterior ribs 64 on the upper closed end of the divider 40 engaging the inner surface of upper end wall of the casing. The assembly is secured in position by means such as screw 65 which connects a flange 66 at the forward end of the mounting bracket 24 to the shroud 56.

The air inlet plenum 44 includes two oppositely extending air inlet passage 67 and 68. In the embodiment illustrated in FIGS. 3 and 4, air inlet passage 68 extends rearwardly toward the back sidewall 70 of the casing and is sealably closed by a cap member 72 thereby rendering the air inlet passage 68 inoperable. However, the purpose of the duel air inlet passages is to provide access to the air suction means from either side of the wall structure 18 thereby permitting service of two areas by the vacuum cleaning system, one on each side of the wall in which it is installed. The back sidewall 70 of the casing is therefore provided with a knock out plug at 74 which when removed provides communication through the back sidewall of the casing into the air inlet passage 68. Thus, when desired an opening may then be provided in the wall panel 76 to provide access to the air suction means from that side of the wall. A flap cover of the type to be heretofore described in conjunction with the other air inlet passage 67 is provided for selectively opening and sealably closing the open end of the passage 68.

Figure 4:
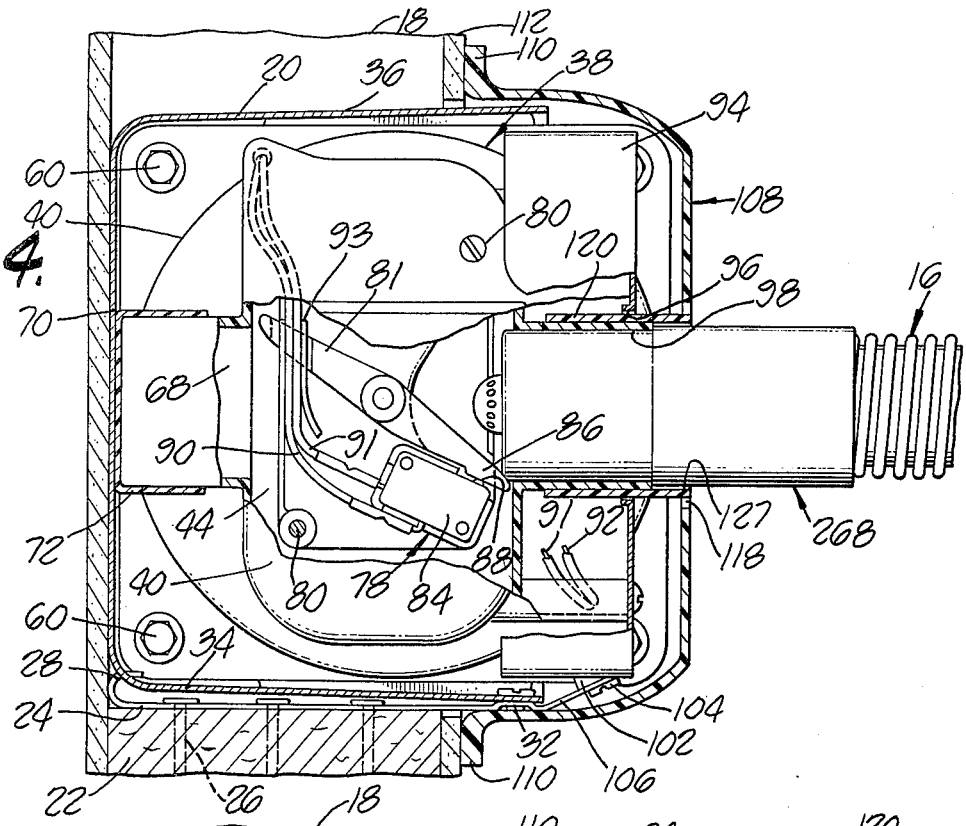
FIG. 4 is a top sectional view of the power unit taken substantially along the lines 4—4 of FIG. 3.
Figure 3:
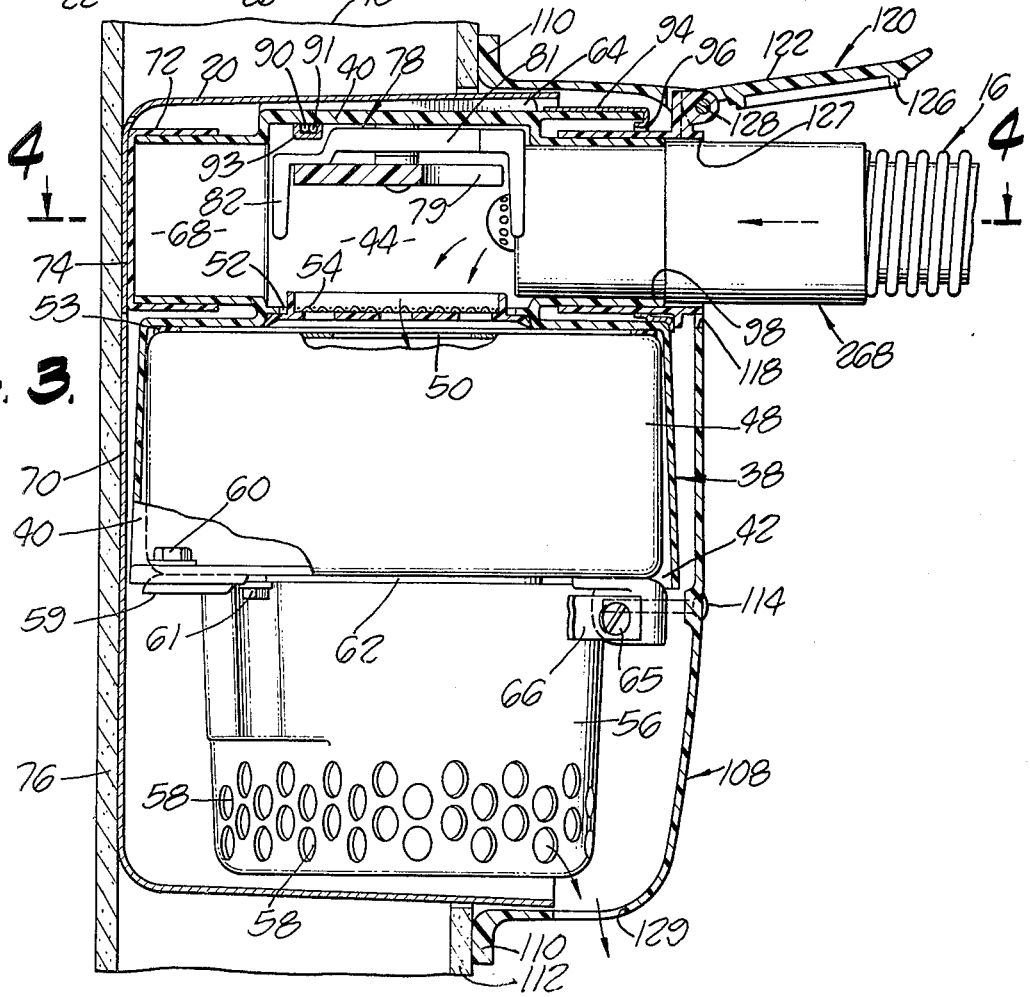
FIG. 3 is a side sectional view of the power unit taken substantially along the lines 3—3 of FIG. 2.
Figure 6:
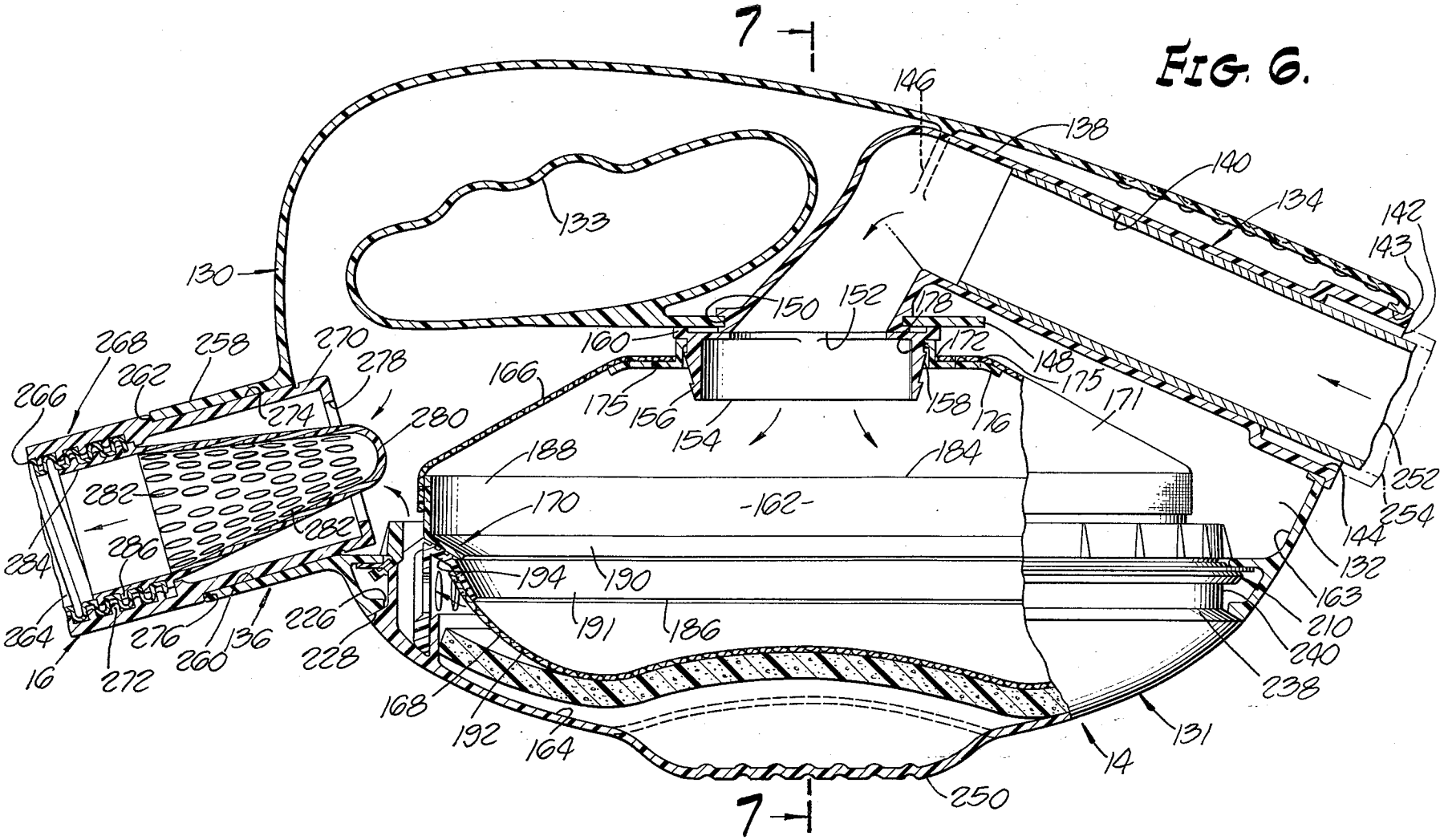
FIG. 6 is a side sectional view of the portable vacuum unit.
Figure 7:
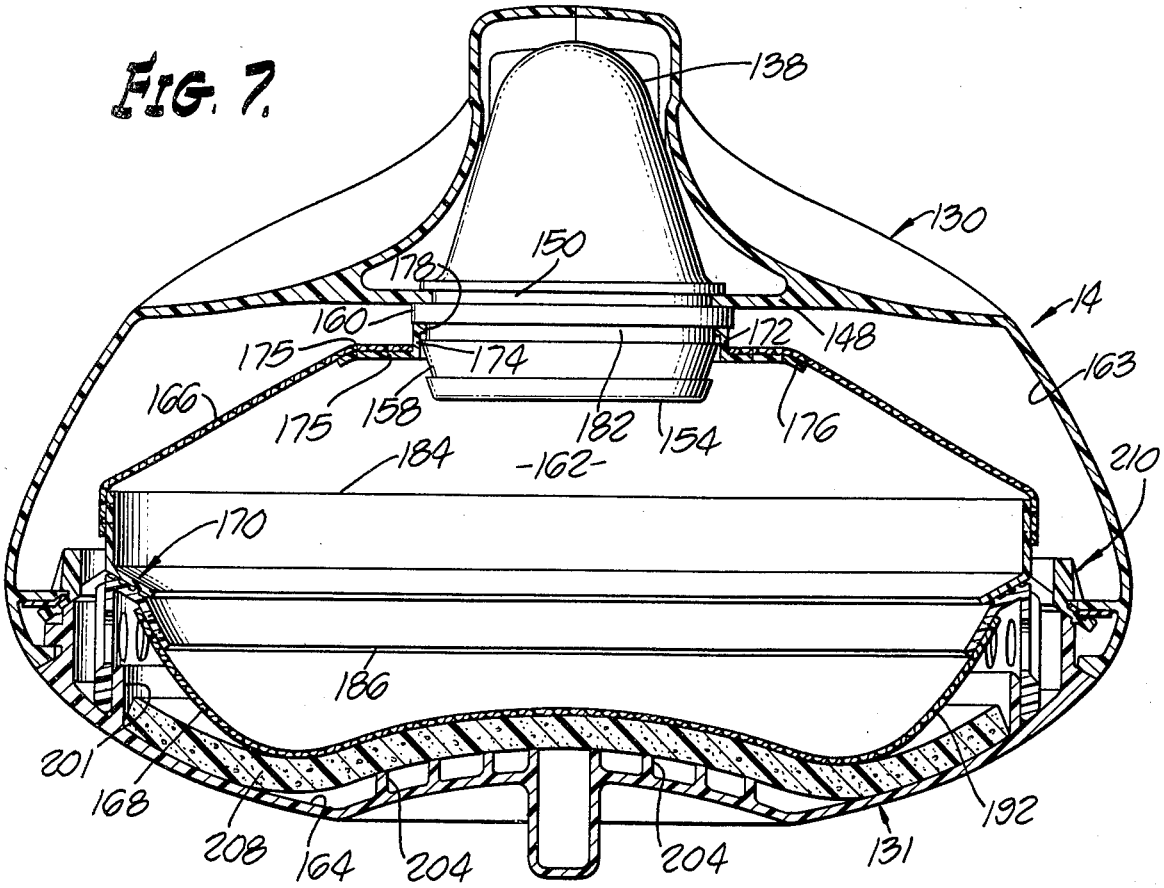
FIG. 7 is a back sectional view of the portable vacuum unit taken substantially along the lines 7—7 of FIG. 6.

Motor 46 is electrically operated by a switch assembly, generally designated 78, mounted within the plenum 44. The switch assembly 78, as best seen in FIGS. 3 and 4, comprises a plastic mounting plate 79 secured to the divider 40 by screws 80, plastic moveable actuator member 81 pivotally mounted to the plate 79 intermediate its ends with arms 82 and 83 depending therefrom and a microswitch 84 secured to the plate 79. The arms 82 and 83 are normally maintained at the ends of the air inlet passages 67 and 68, respectively, for reasons hereinafter to be described with one end 86 of the actuator member 81 positioned adjacent a spring loaded plunger 88 of the microswitch 84. When plunger 88 is depressed to close the switch 84, conductors 90, 91 and 92 electrically connect the electric motor 46 to a suitable source of current. An integral channel 93 of the mounting plate 79 properly maintains the conductors 90 and 91 with respect to the other components of the switch assembly 78.

A metal shield or cover 94 is provided to cover the conductors 90, 91 and 92 which are splice connected during the installation of the power unit. The shield 94 extends across the open side of the casing 20 generally above the power compartment 42 and includes a central opening 96 positioned co-axially about the opening 98 of the air inlet passage 67. The shield 94 is secured to the insulating divider 40 by screws 100 and also includes downwardly extending tabs 102 on each side thereof, one of which is secured by a screw 104 or the like to a flange 106 at the forward end of the mounting bracket 24.

Figure 5:
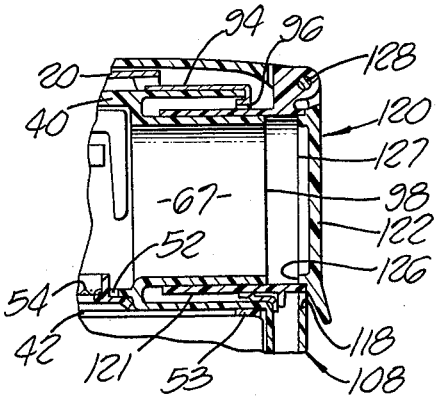
FIG. 5 is a fragmentary side sectional view illustrating an inlet of the power unit.
Figure 2:
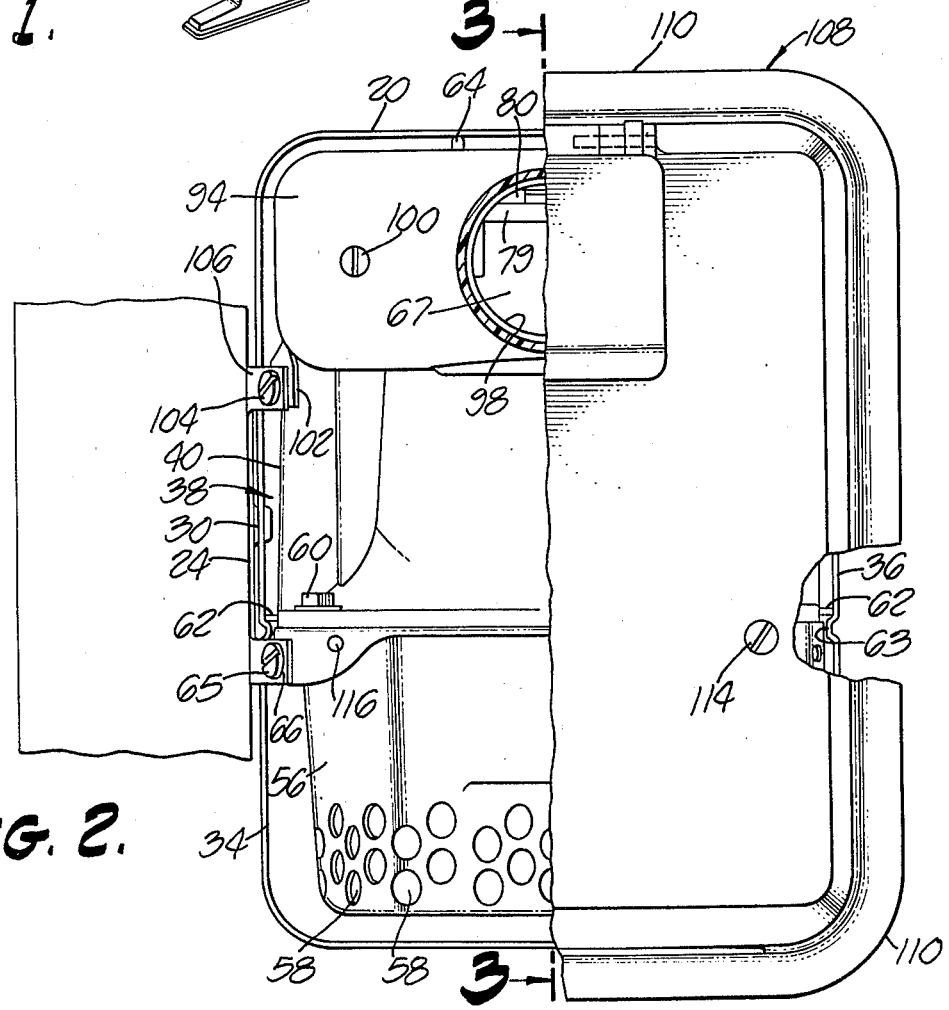
FIG. 2 is a front view partly broken away illustrating the power unit installed within a wall structure.

A cover or face plate, generally designated 108, of a decorative nature and preferably formed of a plastic material includes a marginal, outwardly extending integral flange 110 which fits against the outer surface of the wall panel 112. The face plate 108 encloses the open side of the casing 20 and the assembly 38 slidably mounted therein. The face plate 108 is fixably mounted by screws 114 which secure the face plate 108 to the shroud 56 at 116. The face plate 108 includes an opening 118 which provides access to the air inlet passage 67. A plastic cover assembly generally designated 120, includes a tubular sleeve 121 which slidably fits onto the divider member 40 in a sealed relationship concentrically about the exterior surface of the passage 67 and within the central opening 96 of the shield 94. A flap cover 122 having an annular rib 126 is pivotally mounted at 128 for selective movement between an open position shown in FIG. 3 and a closed position shown in FIG. 5, with the annular rib 126 effecting a seal about the inlet end 127 of the tubular sleeve 121 when the flap cover 122 is closed. Cam means (not shown) and the resilient nature of the plastic material forming the cover assembly 120 bias and maintain the cap in the respective opened and closed positions. The cover plate 108 is also provided with an opening 129 through which air is discharged from the motor.

As seen in FIGS. 6 through 16, the portable vacuum unit 14 broadly comprises a substantially spherical, hollow container, generally designated 130, which is sealably closed by a removable lid, generally designated 131. The closed container generally defines a vacuum chamber 132. The container 130 and lid 131 are preferably plastic and form a significantly light weight and readily manueverable vacuum unit 14 for a housewife handling same. The container 130 includes a handle 133, inlet means, generally designated 134, and outlet means, generally designated 136.

The inlet means 134 includes a tubular elbow member 138 with a tapered passageway 140 extending inwardly from an inlet open end 142 thereof which is coaxially positioned within an opening 143 of the container 130 and secured thereto. The end 144 of the passageway 140 adjacent the inlet end 142 is enlarged for reasons hereinafter described. An interior integral support 146 of the container 130 serves to position and maintain the tubular elbow member 138 within the container as does an integral plate 148 of the container which extends into an annular outer recess 150 about the outlet open end 152 of the tubular elbow member 140. Affixed to the outlet end 152 of the tubular elbow member is a ring member 154 having a pair of tapered exterior annular ribs 156 and 158 and an annular shoulder 160 which abuts one side of the plate 146.

Within the portable vacuum unit 14 and generally symetrically positioned within the vacuum chamber 132 is a closed collection chamber 162, which is spaced radially inwardly from the interior walls 163 and 164 of the container and lid, respectively, thereby providing sufficient clearance therebetween. This surrounding space or clearance permits evacuation of air from the collecting chamber 162 across substantially the entire exterior surface thereof. This feature adds substantially to the operating efficiency of the system for reasons which will be apparent from the following discussion. The collection chamber 162 is defined generally by a dome shaped first filter element 166 and a dome shaped second filter element 168 connected annularly together by a dirt seal assembly, generally designated 170. The first filter element 166 includes a continuous circular sheet of filter media 171 such as cloth or the like with a central opening 172 therein. A resilient plastic cylindrical collar member 174 extends through the opening 172 with the inner periphery of the media 171 secured by means such as stitching 175 to a radially extending shoulder 176 thereof. An inwardly extending annular rib 178 at one end of the collar member 174 fits within the annular groove or recess 182 formed between the rib 156 and the annular shoulder 160 of the ring member 154 thereby securing the first filter element 166 and providing communication with the inlet means 134 of the container 130.

The dirt seal assembly 170, as best seen in FIG. 8, includes first and second pliable plastic seal elements 184 and 186, with the first seal element having a cylindrical section 188 sealably secured to the outer periphery of the filter media 171 by means such as stitching 189 and an inwardly extending frusto-conical annular flange section 190. The second seal element includes a first frusto-conical section 191 secured to the outer periphery of a continuous circular sheet of filter media 192 of the second filter element 168 by such means as stitching 193 and a second frusto-conical section 194 provided with a plurality of annular ribs 196 on one side thereof. The ribs 196 are adapted to be biased against the flat outside surface 198 of the frusto-conical annular flange section 190 of the first seal element 184 when the lid 131 is secured to the container and thereby effect a seal therebetween.

A cylindrical section 200 of the second seal element 186 extending from the second frusto-conical section fits co-axially about an interior annular flange 201 of the lid 131 to secure and position the second filter element thereto. This cylindrical section 200 is also provided with a plurality of spaced openings 202 to permit a flow of air in the vacuum chamber 132 about the collection chamber 162. Laterally extending interior ribs 204 on the lid 131 also maintain the desired clearance for air flow between the exterior of the collection chamber 162 and the interior surface of the lid 131. Preferably, a disc of air porous material 208 concentrically positioned within the annular flange 201 and mounted between the ribs 206 and the filter media 192 of the second filter element 168 is also provided. Moreover, this disc 208 acts as a secondary filter in the area adjacent the filter media 192 where a major portion of the dirt impinges from the outlet 152 of the elbow member 140.

The lid 131 is sealably to the container 130 by an air seal assembly, generally designated 210. Integrally attached to the cylindrical section 188 of the first seal element and extending radially outwardly therefrom is a first seal element 211 of the dirt seal assembly 210 comprising an outer cylindrical ring 212 having an outwardly extending frusto-conical projection 214 with an annular lip 216 at the end thereof. Circumferentially spaced tabs 217 on the exterior surface of the ring 212 and the lip 216 form an annular recess 218. On the other side of the projection 214 substantially opposite the annular recess 218 is an annular rib 220. A plurality of spaced passages 222 between the cylindrical ring 212 and the cylindrical section 188 of the first seal element 184 provide for a flow of air in the vacuum chamber 132 about the collection chamber 162 in a manner similar to the plurality of openings 202.

An integral annular flange 223 extending inwardly from the interior surface 163 of the container extends into the recess 218 with a flexible plastic seal ring 224 mounted between the flange 223 and the projection 214. This secures the other end of the first filter element 168 together with the seal components thereof in place. The seal ring 224 acts both as a seal and a means for self-centering this end of the first filter element 168.

About the opening 225 of the container 130 adapted to receive the lid 131 is an inwardly extending shoulder 226 having a beveled surface 228 and a plurality of three spaced slot openings 228 therein. The periphery of the lid 131 is provided with a beveled surface 238 which corresponds to the beveled surface 228 of the container. Inwardly adjacent the beveled surface 238 of the lid is an axially extending cylindrical sidewall 240 having a beveled end 242 which engages the projection 214 of the seal member 210 and acts on the annular rib 220 to provide a seal therebetween and hold the seal ring 234 in a sealed relationship with respect to the flange 232 and the projection 214.

Adjacent the slot openings 229 are inclined ramps 244 which act as a cam and spaced projections 246 extending radially outward from the cylindrical sidewall 240 of the cover section are provided with inclined surfaces 248 which act as cam followers. Thus, to accomplish the sealed relationship and to secure the lid 131 to the container 130, the spaced projections 246 are aligned with the spaced slot openings 229 and the lid is moved axially inwardly to cause the beveled surface 238 thereof to engage the beveled surface 228 of the container. The lid 131 is then twisted by means of a grip 250 in a clockwise direction to cause the camming action between the ramps 234 and inclined surfaces 248 thereby bringing the various components of the dirt and air seals together in a sealed relationship. A reversal of the above described steps accomplishes a release of the lid from the container.

The inlet 134 of the container is adapted to receive either the end of a metal tubular wand 252 or the ends of other conventional cleaning implements. The end of the wand 252 extends axially into the passageway 140 and the taper of the passageway 140 acts to secure the wand therein. This enlarged cylindrical section 144 of the passageway 140 is generally adapted to receive the ends of other cleaning implements or tools, as indicated by the phantom lines 254, when the wand 252 is not employed.

The outlet 136 of the container generally comprises an integral cylindrical extension 258 defining a passageway 260 therein which extends from an open outlet end 262 to the vacuum chamber 132. The outlet 136 is adapted to receive one end of the flexible suction hose 16 while the other end of the suction hose 16 is adapted to be received by the air inlet passage 67 inlet of the air suction means thereby providing communication for air flow from the portable vacuum unit 14 to the stationary power unit 12. The flexible suction hose 16 generally comprises a hollow tubular plastic conduit 264 with the sidewall thereof including spiral corrugations 266. The connection means, generally designated 268, at each end of the plastic conduit are identical and therefore only one such connection means will be described in detail. The connection means 268 includes a relatively rigid cylindrical plastic cap 270 having internal spiral threads 272 threadably connected to the spiral corrugations 266 to thereby secure the cap 270 to the end of the conduit. The cap 270 also includes a reduced exterior surface 274 which terminates at an annular shoulder 276. The shoulder 276 determines the axial extension of the cap 270 within the outlet of the vacuum unit or within the inlet of the power unit. Positioned co-axially within the cap 270 and extending beyond the open end 278 thereof is a conical member 280 having a plurality of aperatures 282 therethrough. The open cylindrical end 284 of the conical member 280 is provided with exterior spiral threads 286 which are received by the internal spiral corrugations of the conduit to secure the conical member thereto. The conical member 280 prevents particulate matter from passing through the hose and on into the power unit when the hose is detached from vacuum unit. In addition, there are a plurality of three circumferentially spaced openings (not shown) about the cylindrical cap 270 which also reduce the suction at the open end 278 to further avoid the passing of particulate matter through the hose when it is detached from the vacuum unit. These openings are, however, covered by the cylindrical extension 258 of the vacuum unit outlet when the hose is connected thereto to thereby provide full suction through the open end 284 of the hose.

Figure 16:
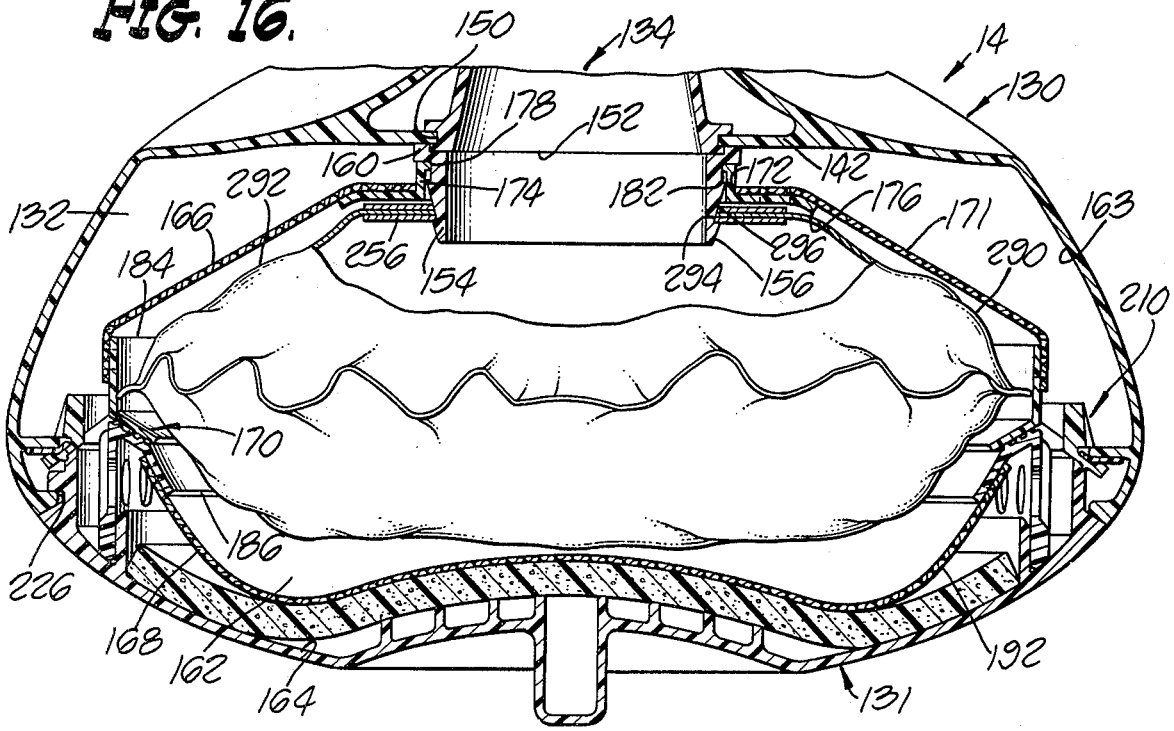
FIG. 16 is a back sectional view illustrating an alternative embodiment of the collection chamber of the vacuum unit.

In an alternative embodiment of the invention seen in FIG. 16, a bag 290 is employed within the collection chamber 162 to collect the dirt and dust particles sucked into the vacuum unit 14. The bag 290 generally comprises a bag or paper filter media 292 having a central opening 294 into the interior thereof which is re-inforced by a collar member 296. The collar member 296 is adapted to fit into the annular groove 298 formed between the annular ribs 156 and 158 of the ring member 154 and thereby provide between the bag 290 and the inlet of the container. Although use of the bag 290 is oftentimes preferable, it should be kept in mind that the vacuum cleaning system 10 will function without the bag 290 since the connected filter elements 166 and 168 serve in the same capacity as the bag 290.

When operating the vacuum cleaning system 10, the container 130 is closed by the lid 131 with or without a bag 290 contained within the collection chamber 162. The tightening of the lid 131 automatically connects the first and second filter elements 166 and 168 defining the collection chamber 162, automatically brings the components of the air seal assembly together in a sealed relationship and automatically brings the components of the dust or dirt seal assembly together in a sealed relationship. The wand 252 or other cleaning implements are secured to the inlet 134 of the closed container 130 and one end of the hose 16 is attached to the outlet 136 of the closed container 130. The other end of the hose is then inserted into either the inlet passage 67 or the inlet passage 68, if operable, of the power unit 12 after the appropriate flap cover thereof has been opened. In this regard it should be noted that the end cap 268 of the hose 16 is adapted to engage the arm of the actuator 81 at the end of the inlet passage and thereby cause the plunger 88 of the micro-switch to be depressed. This automatically activates the motor of the power unit to cause air to flow through the system 10 from a cleaning tool at the end of the wand 252 or from a cleaning implement secured to the inlet of the vacuum unit 14.

It is important to note that during operation substantially all of dirt or dust or other particulate matter sucked into the system 10 is trapped within the collection chamber 162 and therefore does not pass into the flexible hose 16 where it might become trapped and thereby clog the hose. Moreover, the collection of the dirt or other particulate matter at a location remote from the power unit 12 and improved sealing of the collection chamber to prevent leakage of the particulate matter therefrom avoids impairment of the power unit. In this regard, it should be noted that the perforated conical member 280 at each end of the hose 16 and the screen 54 provide a further check against particulate matter entering into the motor of the power unit.

Another important feature of the invention involves the evacuation of the air from the collection chamber 162 which occurs substantially across the entire surface of the filter media and symmetrically thereabouts. This avoids a build-up or snowdrifting of the collected matter within one portion of the collection chamber 162 which occures when evacuation is restricted to a localized area of the filter media thereby restricting air flow through the system since the air must be drawn built-up, collected matter and substantially reducing the overall efficiency of the system. Moreover, the substantially spherical shape of the collection chamber maximizes the filter media surface area per volume of dirt collection capacity.

It should also be noted that the vacuum chamber 132 acts as a plenum chamber which adjusts the suction force according to the load at the working end of the cleaning tool. That is, full suction is not achieved until the air within the vacuum chamber 132 is evacuated and the inlet providing air thereto is completely shut off. Thus, for items such as drapes or the like which are substantially more porous than carpets or rugs and which create a substantially lesser load on the system, a reduced suction force is applied to avoid the problem of drawing the drapes up into the cleaning implement.

When the vacuum cleaning operation is completed or when it is desired to empty the collected dirt, dust or other particulate matter from the container, if a bag 290 is used, the lid 131 is removed from the container 130 and the bag 290 pulled from the ring 154 and disposed of or, if a bag 290 is not used, the container is inverted before the lid 131 is removed therefrom and the contents within the collection chamber 162 are dumped therefrom. Moreover, because the non-plastic components of the container are readily removeable the container may be washed out with water if desired.

Thus, it is readily apparent from the foregoing description that the present invention provides a highly efficient and substantially trouble free built-in vacuum cleaning system. Dirt or other particulate matter is trapped and collected before it enters components of the system, such as the flexible hose, where it might clog the system and before it enters components of the system, such as the motor, which it might damage. The new and improved sealing means of the system and in particular the tight dust and air seals of the portable vacuum unit together with the unique manner of evacuating air uniformly across substantially the entire filter media surface provide for an increased operating efficiency. In addition, the dual inlet of the power unit provides greater accessibility to areas to be serviced by the system.

Having fully described my invention, it is to be understood that I do not wish to be limited to the detail set forth, but my invention is of the full scope of the apended claims.

I claim:

1. In a vacuum cleaning system, a portable vacuum unit, comprising:

a housing having an inlet, an outlet, and a vacuum chamber therebetween through which air flows;

said housing having a removable lid attached thereto defining said vacuum chamber;

a flanged member secured to said housing;

a closed collection filter chamber connected with said inlet, said collection filter chamber including a filter means comprising a pair of separable and substantially hemispherical filter elements including flanged means joining said filter elements and said flanged member, said filter elements being joined so as to form a filter means enclosure adapted to trap particulate matter drawn into said inlet along with air and surrounded by said vacuum chamber thereby permitting evacuation of air from said collection chamber substantially uniformly across the surface of said filter means; and air seal means sealably attaching said lid and said container to prevent a leakage of air therebetween.

2. The system of claim 1, wherein said power unit is fixably mounted, said vacuum unit is portable, and said conduit means comprises a flexible hose to permit suction of particulate matter into said vacuum unit remote from said power unit.

3. The system of claim 1, wherein a disposable bag of filter media is included within said collection chamber and within said filter means to hold the trapped particulate matter.

4. A vacuum cleaning system as claimed in claim 1 including a power unit having air suction generating means, and conduit means connecting said vacuum housing unit to said power unit for communication of air flow therebetween.

5. A vacuum cleaning system as claimed in claim 1 including a power unit having an air inlet, an air outlet, and air suction generating means therebetween, annular seal means sealably connecting said filter media elements to prevent a leakage of particulate matter and means providing for communication for air flow between said air inlet of said power unit and said outlet means of said vacuum unit.

6. The system of claim 1, wherein said annular seal means includes annular flange members sealably secured to the peripheries of said filter media elements, with at least one of said flange members being resilient and means biasing said flange members together in a sealed relationship.

7. The system of claim 1, wherein one of said flange members includes annular ribs adapted to contact said other flange member.

8. The portable vacuum unit of claim 1, wherein inclined surfaces included on said lid engage complimentary inclined surfaces on said container when said lid is twistably attached to said container to bias elements of said air seal means together.

9. The portable vacuum unit of claim 8, wherein said filter means includes a pair of joined separable filter elements, one of which is operably connected to said lid and the other of which is operably connected to said container whereby detachment of said lid from said container permits the emptying of particulate matter trapped within said filter means.

10. The portable vacuum unit of claim 9, wherein each said filter element is substantially hemispherical with annular dirt seal means sealably connecting the outer peripheries thereof thereby preventing a leakage of particulate matter therebetween.

11. The portable vacuum unit of claim 10, wherein said dirt seal means includes a first seal element secured to said filter element connected to said container and secured to said container and a second seal element secured to filter element connected to said lid and secured to said lid whereby the attachment of said lid to said container forces said first and second seal elements together in a sealed relationship.

12. The portable vacuum unit of claim 11, wherein air flow passageways are provided in said first seal element between filter element and said container and air flow passageways are provided in said second seal element and said lid to permit the flow of air in said vacuum chamber in a continuous path about said collection chamber.

13. The portable vacuum unit of claim 9, wherein means are provided to support said filter elements in a spaced relationship with respect to said interior surfaces of said lid and said container.

14. The portable vacuum unit of claim 8, wherein said air seal means comprises includes a first sealing surface on said container, a second sealing surface on said lid, and first and second seal elements therebetween adapted to effect a seal between said surfaces, said first seal element including a recess adapted to receive said first sealing surface and said second seal element comprising a seal ring having an annular flange positioned within said recess between said first sealing surface and said first seal element which concentrically positions said first seal element with respect to said first and second sealing surfaces.

15. The portable vacuum unit of claim 14. wherein said first seal element includes a radially outwardly extending resilient projection adjacent said recess with an annular lip on one side thereof adapted to engage said seal ring and the other side thereof adapted to engage said second sealing surface, and means biasing said sealing elements against said sealing surfaces when said lid is attached to said container.

* * * * *